US009216602B2

(12) United States Patent
Igarashi et al.

(10) Patent No.: US 9,216,602 B2
(45) Date of Patent: Dec. 22, 2015

(54) PRINTING APPARATUS AND METHOD FOR CONTROLLING SHEET PROCESSING APPARATUS

(75) Inventors: Yuki Igarashi, Kawasaki (JP); Masahiro Koshikawa, Kawasaki (JP); Shuuichi Masuda, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 897 days.

(21) Appl. No.: 12/724,804

(22) Filed: Mar. 16, 2010

(65) Prior Publication Data

US 2010/0238225 A1 Sep. 23, 2010

(30) Foreign Application Priority Data

Mar. 19, 2009 (JP) ..... 2009-067906

(51) Int. Cl.

| | |
|---|---|
| ***B41J 29/38*** | (2006.01) |
| ***B41J 29/393*** | (2006.01) |
| ***B41J 2/01*** | (2006.01) |
| ***B41J 11/00*** | (2006.01) |
| ***B41J 15/04*** | (2006.01) |
| *B41J 11/42* | (2006.01) |

(52) U.S. Cl.

CPC ..... *B41J 29/393* (2013.01); *B41J 11/001* (2013.01); *B41J 11/0095* (2013.01); *B41J 15/04* (2013.01); *B41J 11/42* (2013.01)

(58) Field of Classification Search

CPC ..... B41J 11/42; B41J 29/393; B41J 11/007; B41J 11/06; B41J 2/2114; B41J 11/0015; B41J 2/325; B41J 17/02; B41J 2/32; B41J 11/001; B41J 11/0095; B41J 15/04; B41J 11/008; B41J 13/009; B41M 5/38207

USPC ..... 347/16, 19, 104, 215, 217, 218, 14; 358/498; 399/396

See application file for complete search history.

(56) References Cited

U.S. PATENT DOCUMENTS

| | | | | | |
|---|---|---|---|---|---|
| 3,989,370 | A | * | 11/1976 | Mooney | 399/70 |
| 4,740,096 | A | * | 4/1988 | Nakanishi | 400/663 |
| 4,855,754 | A | * | 8/1989 | Tanaka et al. | 346/17 |
| 4,941,109 | A | * | 7/1990 | Kikukawa | 358/1.12 |
| 5,075,841 | A | * | 12/1991 | Kaneko | 714/36 |
| 5,169,249 | A | * | 12/1992 | Kitabata | 400/582 |
| 5,199,806 | A | * | 4/1993 | Fujioka et al. | 400/616 |
| 5,309,195 | A | * | 5/1994 | Goo et al. | 396/302 |
| 5,350,245 | A | * | 9/1994 | Gallagher | 400/582 |
| 5,390,016 | A | * | 2/1995 | Hoshi et al. | 399/371 |
| 5,448,343 | A | * | 9/1995 | Nakamichi et al. | 399/313 |
| 5,457,516 | A | * | 10/1995 | Kim | 399/37 |

(Continued)

FOREIGN PATENT DOCUMENTS

| | | | | |
|---|---|---|---|---|
| JP | 62071685 | A | * | 4/1987 |
| JP | 62290563 | A | * | 12/1987 |

(Continued)

*Primary Examiner* — Julian Huffman
*Assistant Examiner* — Leonard S Liang
(74) *Attorney, Agent, or Firm* — Canon USA, Inc. IP Division

(57) ABSTRACT

A method includes determining, if power to an apparatus is turned on, whether a state of a sheet has been changed while the power is off, based on a change of the sheet state before turn-off and after turn-on of the power, and performing control to perform initializing operations according to a result of the determination.

19 Claims, 7 Drawing Sheets

(56) References Cited

U.S. PATENT DOCUMENTS

| | | | | |
|---|---|---|---|---|
| 5,602,651 | A * | 2/1997 | Tabata et al. | 358/448 |
| 5,639,171 | A * | 6/1997 | Brewster et al. | 400/708 |
| 5,764,253 | A * | 6/1998 | Uchikata et al. | 347/23 |
| 5,812,745 | A * | 9/1998 | Kim et al. | 358/1.14 |
| 5,885,010 | A * | 3/1999 | Kim | 400/54 |
| 5,915,078 | A * | 6/1999 | Miyasaka et al. | 358/1.12 |
| 6,000,865 | A * | 12/1999 | Takamizawa et al. | 400/74 |
| 6,172,688 | B1 * | 1/2001 | Iwasaki et al. | 347/2 |
| 6,226,472 | B1 * | 5/2001 | Yun | 399/81 |
| 6,301,450 | B1 * | 10/2001 | Kojima et al. | 399/24 |
| 6,431,680 | B1 * | 8/2002 | Shinada | 347/19 |
| 6,511,150 | B1 * | 1/2003 | Yoda et al. | 347/23 |
| 6,693,717 | B1 * | 2/2004 | Teradaira et al. | 358/1.14 |
| 6,747,429 | B2 * | 6/2004 | Igarashi | 318/560 |
| 6,789,869 | B2 * | 9/2004 | Takeishi | 347/16 |
| 6,914,696 | B1 * | 7/2005 | Kojima et al. | 358/1.16 |
| 6,978,113 | B2 * | 12/2005 | Kamimura et al. | 399/388 |
| 7,525,564 | B2 * | 4/2009 | Okamoto et al. | 347/262 |
| 7,548,326 | B2 * | 6/2009 | Fukushima | 358/1.12 |
| 7,971,954 | B2 * | 7/2011 | Ito | 347/16 |
| 8,226,198 | B2 * | 7/2012 | Snyder et al. | 347/16 |
| 8,270,041 | B2 * | 9/2012 | Fujiwara | 358/448 |
| 2001/0024585 | A1 * | 9/2001 | Koakutsu et al. | 400/76 |
| 2002/0018097 | A1 * | 2/2002 | Kitahara et al. | 347/42 |
| 2002/0122684 | A1 * | 9/2002 | Ikeda et al. | 400/578 |
| 2003/0016259 | A1 * | 1/2003 | Otokita | 347/14 |
| 2005/0100385 | A1 * | 5/2005 | Sato | 400/708 |
| 2007/0216718 | A1 * | 9/2007 | Mizuno | 347/16 |
| 2008/0114996 | A1 * | 5/2008 | Suzuki | 713/320 |
| 2009/0122096 | A1 * | 5/2009 | Fujita | 347/16 |
| 2010/0079525 | A1 * | 4/2010 | Suzuki | 347/14 |

FOREIGN PATENT DOCUMENTS

| | | | |
|---|---|---|---|
| JP | 01183729 | A * | 7/1989 |
| JP | 02108572 | A * | 4/1990 |
| JP | 04320870 | A * | 11/1992 |
| JP | 09258618 | A * | 10/1997 |
| JP | 10100513 | A * | 4/1998 |
| JP | 2000006483 | A * | 1/2000 |
| JP | 2000-99214 | A | 4/2000 |
| JP | 2000094807 | A * | 4/2000 |
| JP | 2000191183 | A * | 7/2000 |
| JP | 2009113451 | A * | 5/2009 |

* cited by examiner

PRINTING APPARATUS AND METHOD FOR CONTROLLING SHEET PROCESSING APPARATUS

BACKGROUND OF THE INVENTION

1. Field of the Invention

The present invention relates to a printing apparatus for performing printing on a sheet.

2. Description of the Related Art

A printing apparatus discussed in Japanese Patent Application Laid-Open No. 2000-99214 stores a result of processing at the time when the power is turned off in an electrically erasable and programmable read only memory (EEPROM), which is a non-volatile memory. When the power is then turned on, control for performing initializing operations is executed according to the stored result of the processing.

When a sheet state (a type and a position of the sheet, etc.) is changed by sheet exchange or the like, operations corresponding thereto (resetting of the type and a width of the sheet, alignment of the sheet, skew correction, etc.) are required. The sheet state may be changed by a user exchanging the sheet and shifting the position of the sheet, for example, while the power is off. Therefore, various initializing operations, including the above described operations, are performed when the power is turned on.

If the sheet state is not changed, the above described operations are not originally required. However, it is not found whether the user has changed the sheet state while the power is off. Therefore, all predetermined initializing operations are generally performed when the power is turned on. Such initializing operations that may not be originally necessary prevent reduction in starting time of the printing apparatus.

SUMMARY OF THE INVENTION

According to an aspect of the present invention, an apparatus in which initializing operations are performed when power is turned on includes a holding unit configured to store a sheet, a printing unit configured to convey the sheet by a conveyance roller pair and perform printing thereon, and a control unit configured to control driving of the conveyance roller pair, wherein the control unit performs control to convey and stop the sheet such that a leading edge of the sheet is in a predetermined state before the power is turned off and to determine whether the leading edge of the sheet is in the predetermined state when the power is turned on, and when it is determined that the leading edge of the sheet is in the predetermined state, the control unit does not perform at least a part of the initializing operations.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings. It is to be noted that components and numerical expression set forth in these embodiments are merely examples and not intended to limit the scope of the present invention.

An inkjet large-format printing apparatus that performs printing on a roll sheet wound in a roll or a cut sheet previously cut to a standard size (hereinafter merely referred to as a sheet) will be described as an example. The printing apparatus according to the present invention is widely applicable to apparatuses that include a printing function such as a single function printer, a multifunction peripheral, a copying machine, a facsimile apparatus, a film developing apparatus, and various types of manufacturing apparatuses. The present invention is also applicable to a sheet processing apparatus that executes predetermined processes on a sheet. Examples of the inkjet system includes various systems such as a system using a heating device, a system using a piezoelectric element, a system using an electrostatic element, and a system using a micro electro mechanical system (MEMS) element. A printing system is not limited to the inkjet system, and is also applicable to various systems such as an electrophotographic system and a thermal transfer system.

Figure 1:
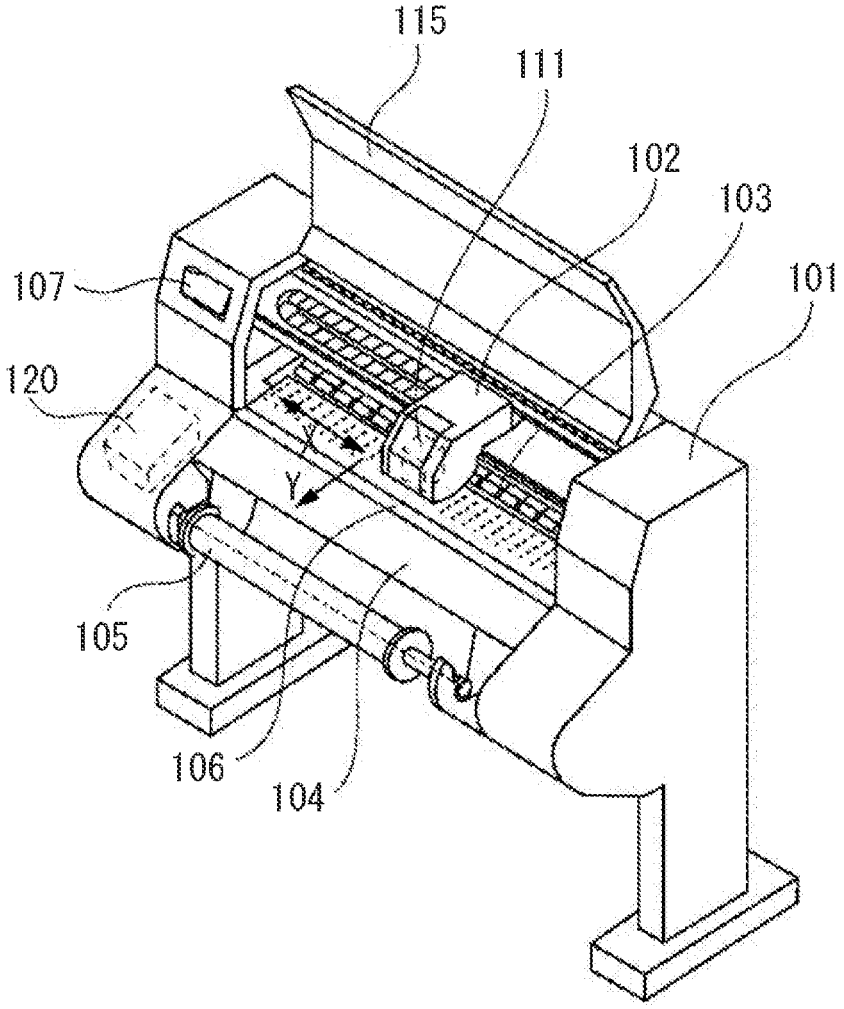
FIG. 1 is a perspective view illustrating a whole configuration of a printing apparatus.

FIG. 1 is a perspective view illustrating a whole configuration of a printing apparatus according to a first exemplary embodiment. The printing apparatus includes a frame 101, a sheet feeding unit 103, a printing unit 106, a discharging unit 104, an operation unit 107, and a control unit 120.

A sheet 105 is rotatably set in a holder (a sheet holding unit) provided on a front side of the frame 101. Sheets of various sheet types and with various sheet widths are usable as the sheet 105. A user exchanges the sheet 105 (puts and takes the sheet 105 in and out of the holder). The user sets a new sheet 105 in the holder, and then inserts a leading edge of the sheet 105 into the sheet feeding unit 103. A cut sheet can be also inserted into the sheet feeding unit 103. Alternatively, either one of a roll sheet and a cut sheet can be selectively used.

The sheet feeding unit 103 supplies the sheet 105 stored in the holder to the printing unit 106 while pulling out the sheet 105. The printing unit 106 conveys the supplied sheet 105 to perform printing thereon using the inkjet system. The discharging unit 104 discharges the sheet 105 on which the printing has been performed. The operation unit 107 includes an input button for the user performing various types of setting for the printing, a power switch (power button) for turning the power on/off, and a display for displaying various types of statuses. The control unit 120 includes a central processing unit (CPU), a memory, and various types of input/output (I/O) interfaces, and performs control of the whole apparatus including driving control of various types of operation units in the whole apparatus and control of an operation sequence, described below.

The printing unit 106 includes a conveying mechanism for conveying the sheet 105 in a sub-scanning direction (a Y direction in FIG. 1) and a carriage which reciprocally moves in a main scanning direction (an X direction in FIG. 1) with a print head 111 carried thereon. Although the printing apparatus according to the present exemplary embodiment is a serial printing apparatus for printing by main scanning and sub-scanning, it may be a line printing apparatus using a fixed full line print head.

The conveying mechanism includes a line feed (LF) roller 108 serving as a conveyance roller pair for conveying the sheet 105 in the sub-scanning direction by nipping the sheet 105 therein, and a plurality of pinch rollers 109 that is urged against the LF roller 108 and is driven to rotate. The sheet 105 is held by suction on a platen 110 at a printing position. A cutter for cutting the sheet 105 is provided in the vicinity of an end edge in a sheet conveyance direction (on a downstream side) of the platen 110. When a cover 115 that can be opened or closed for maintenance is opened, the user can access the inside of the printing apparatus.

Figure 2:
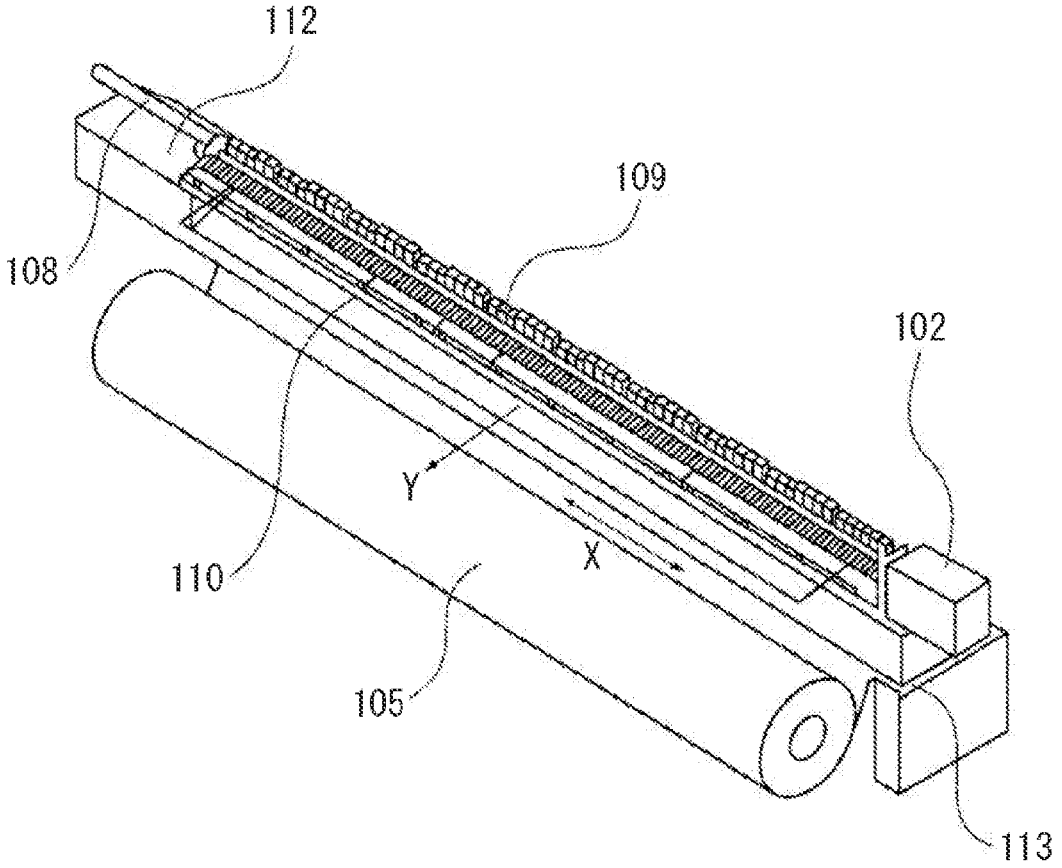
FIG. 2 is a perspective view illustrating a principal internal configuration of the printing apparatus.

FIG. 2 is a perspective view illustrating the principal internal configuration of the printing apparatus. The platen 110 is supported on a casing 112 which serves as a support frame. The platen 110 has a support surface for guiding and supporting the sheet 105 from below such that the print head 111 and the sheet 105 are properly spaced at the printing position. A large number of air suction holes are provided on the support surface of the platen 110 such that the sheet 105 can be suctioned on the support surface at a negative pressure.

In order to supply the negative pressure to the air suction holes, the casing 112 has a duct structure including a sealed internal space. The internal space and the air suction holes of the platen 110 communicate with each other. In order to supply the negative pressure to the air suction holes via a duct of the casing 112, a suction unit 113 which serves as a negative pressure generation source is connected to the duct of the casing 112. The suction unit 113 includes a fan. The fan rotates to exhaust the air in the duct to the exterior, to generate the negative pressure in the duct.

Figure 3:
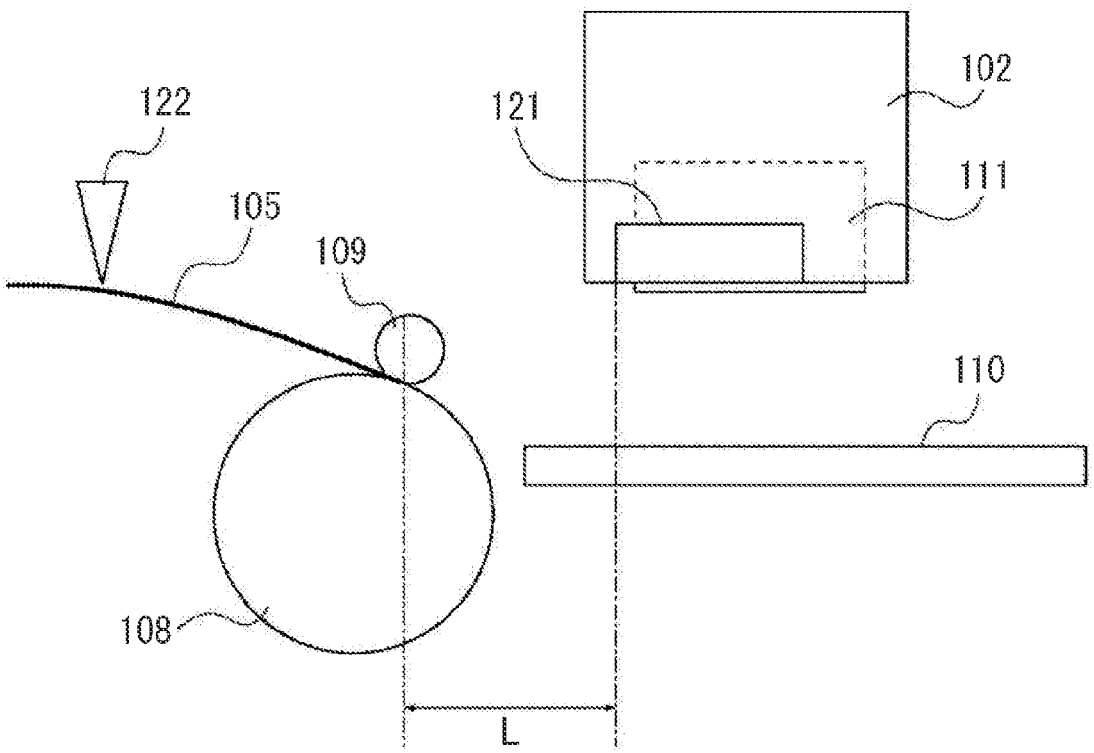
FIG. 3 is a cross sectional view of a printing unit.

FIG. 3 is a cross sectional view of the printing unit 106, illustrating a state in which the leading edge of the sheet 105 is positioned at a nipping position of the conveyance roller pair (the LF roller 108 and the pinch roller 109) and is nipped thereby. A sheet edge sensor 122 (second sensor) detects an edge (the leading edge or a trailing edge) of the conveyed sheet 105 and presence or absence of the sheet 105 at a detection position, and outputs a signal representing a result of detection. The detection position is a predetermined position on a near side (on an upstream side in the sheet conveyance direction) of the nipping position of the conveyance roller pair. The sheet edge sensor 122 detects the edge of the sheet 105 in an optical or physical method, and is attached to a pinch roller holder (not illustrated). The nipping in the conveyance roller pair can be opened and closed by operating a lever (not illustrated).

On the other hand, the carriage 102 is provided with a multisensor 121 (first sensor) for detecting the presence or absence of the sheet 105 on the platen 110 opposed thereto. As the carriage 102 moves in the main scanning direction, the detection position of the multisensor 121 varies in the main scanning direction. However, the carriage 102 does not move in the sub-scanning direction, so that the detection position of the multisensor 121 is constant in the sub-scanning direction. The detection position is a predetermined position on the platen 110 which is at a predetermined distance (distance L) in the sub-scanning direction (Y direction) in the downstream side in the sheet conveyance direction from the nipping position of the conveyance roller pair.

When the nipping position of the conveyance roller pair and a height position of the support surface of the platen 110 differ, a distance in the sub-scanning direction is the distance L. However, a length of the sheet 105 from the nipping position to the detection position is slightly larger than the distance L.

The multisensor 121 is an optical sensor which includes a plurality of light emitting elements that differ in luminescent color (e.g., two red and green light emitting diodes (LEDs)) and a light receiving element. The multisensor 121 receives in the light receiving element light reflected from the detection position irradiated with light from the light emitting elements, detects whether the sheet 105 exists at the detection position, and outputs a result of the detection. The multisensor 121 can determine the type and the width of the sheet 105 by detecting surface reflectance and a surface state of the sheet 105 and further determine a thickness of the sheet 105 by detecting a distance between the sensor and the sheet 105. Thus, the multisensor 121 is a multipurpose sensor capable of detecting a plurality of different pieces of information relating to a sheet, and constitutes a part of a detection unit.

An operation sequence of the printing apparatus with the above described configuration will be described. The operation sequence is executed by the control of the control unit 120.

Figure 4:
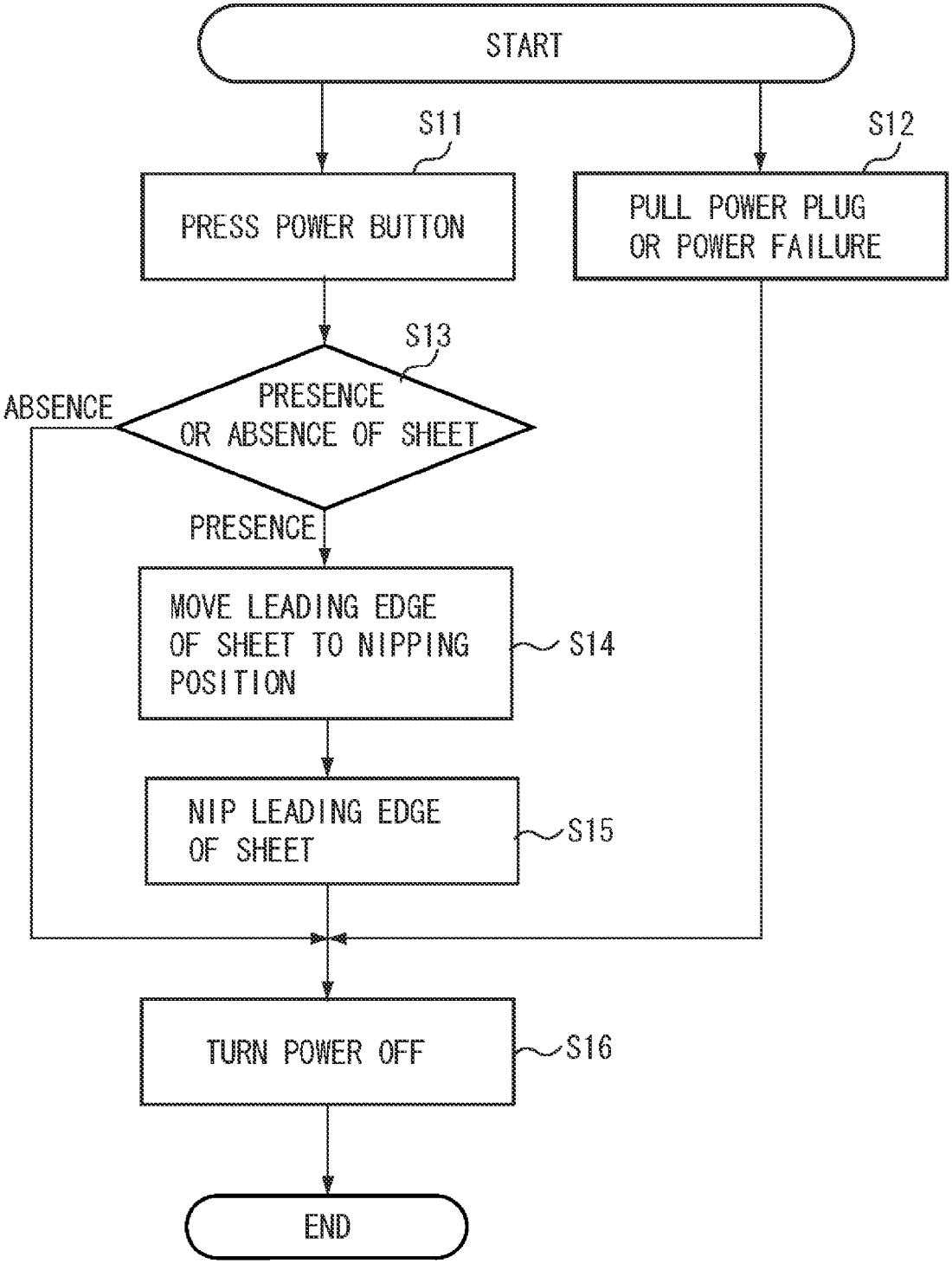
FIG. 4 is a flowchart illustrating an operation sequence of termination processing.

FIG. 4 is a flowchart illustrating an operation sequence of termination processing performed when the power to the printing apparatus that is being energized is turned off. Two methods are assumed to turn the power to the printing apparatus off. One of the methods is normal termination, in step S11, in which the user operates the power switch (presses the power button) on the operation unit 107, to issue an instruction to turn the power off. The other is abnormal termination, in step S12, in which the user suddenly pulls a power plug from an outlet or the power fails so that the energization is suddenly stopped. In the case of the abnormal termination, the processing proceeds to step S16 and the power is turned off.

When the power switch is operated (the normal termination), the leading edge position of the sheet is brought into a predetermined state before the power is turned off in the following procedure. In step S13, the control unit 120 first detects the presence or absence of the sheet from an output of the sheet edge sensor 122. If the absence of the sheet is detected in step S13, the processing proceeds to step S16. In step S16, the power is turned off. The determination in step S13 may be omitted, to always perform step S14 and the subsequent steps in the case of the normal termination.

If the presence of the sheet is detected in step S13, the processing proceeds to step S14. In step S14, the control unit 120 moves the leading edge of the sheet to the nipping position of the conveyance roller pair. In step S15, the control unit 120 stops the conveyance of the sheet at a state that the leading edge of the sheet is nipped at the nipping position, as illustrated in FIG. 3.

There are two methods for stopping the sheet to enter the state illustrated in FIG. 3. In the first method, the sheet is moved in such a direction as to be returned toward the upstream side while operating the multisensor 121. Conveyance control is preformed to stop the sheet at a position where the sheet is returned by a distance corresponding to the distance L in the sub-scanning direction from timing at which detection by the multisensor 121 has been changed from the presence to the absence of the sheet.

If the first detection by the multisensor 121 is the absence of the sheet, the conveyance control is performed in the above described procedure after the sheet is conveyed toward the downstream side once and fed until the detection is switched to the presence of the sheet. In the second method, conveyance control is performed to cut the sheet with the cutter and then stop the sheet at a position where the sheet is returned by a distance (a fixed value) from a cutting position (the vicinity of the trailing edge of the platen 110) to the nipping position of the conveyance roller pair in the conveyance direction. Then, the processing proceeds to step S16 and the power is turned off.

The state illustrated in FIG. 3 is a reference state (the leading edge of the sheet is in a predetermined state) for determining whether the user has exchanged the roll sheet while the power is off, as described below. A state in which the leading edge of the sheet is nipped with it reaching a position at a predetermined distance S which is smaller than the distance L in the downstream side in the sub-scanning direction farther than in the state illustrated in FIG. 3 may be the reference state (the leading edge of the sheet is in the predetermined state). In this case, the "distance L" in the following description is read as "distance L-distance S".

Figure 5:
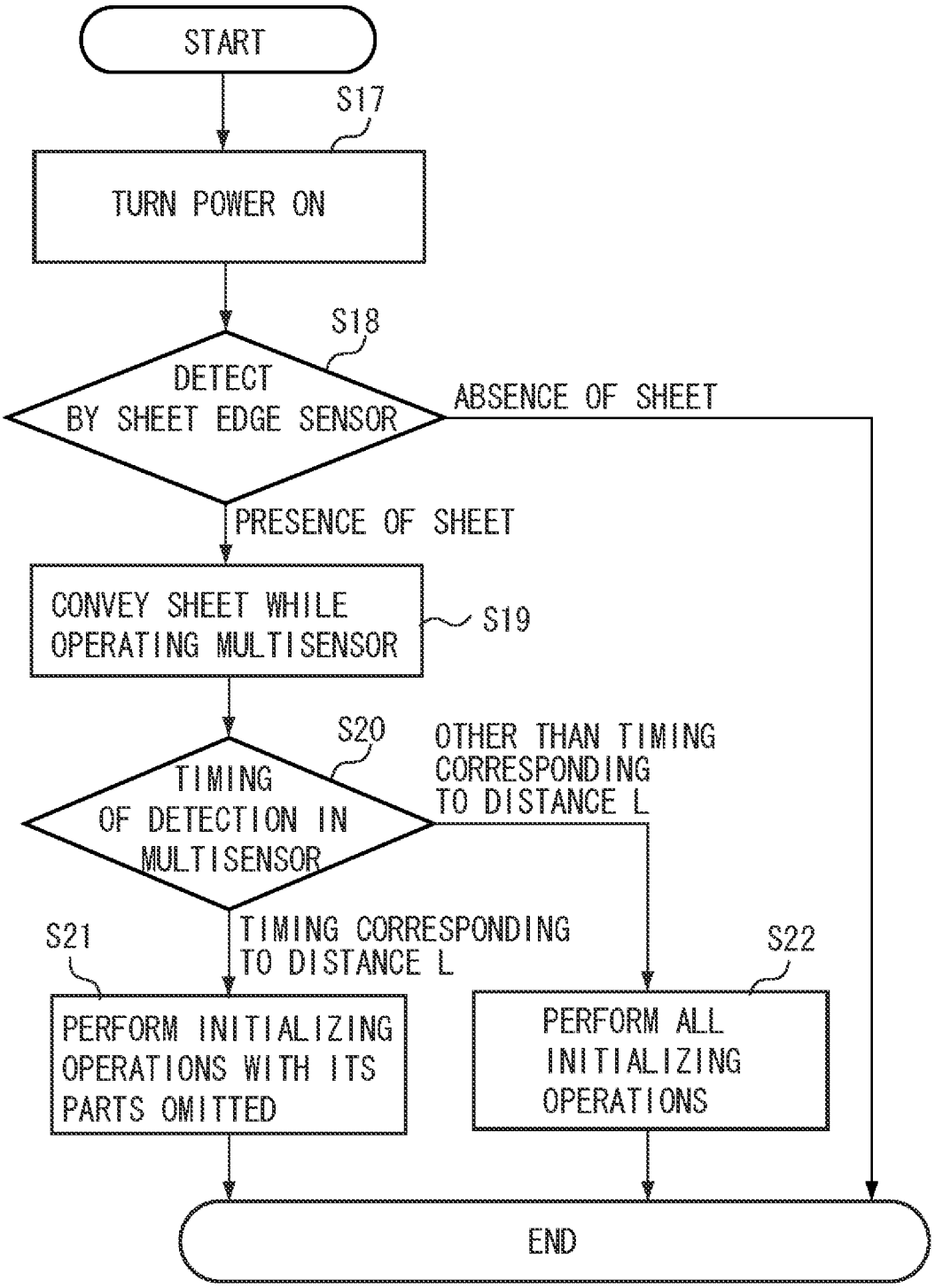
FIG. 5 is a flowchart illustrating an operation sequence of start processing.

FIG. 5 is a flowchart illustrating an operation sequence of start processing relating to sheet feeding performed when the power is turned on. When the printing apparatus is started, initializing operations relating to printing such as a recovery operation of a print head are performed. However, such operations are performed irrespective of the presence or absence of sheet exchange and hence, the description thereof is omitted.

In step S17, the user operates the power switch (presses the power button), to turn the power on. In step S18, the control unit 120 detects the presence or absence of the sheet from an output of the sheet edge sensor 122. If the absence of the sheet is detected in step S18, all initializing operations relating to sheet feeding are omitted. The operation sequence is terminated, to perform the initializing operations relating to printing.

On the other hand, if the presence of the sheet is detected in step S18, the processing proceeds to step S19. In step S19, the control unit 120 conveys the sheet by a distance greater than the distance L (see FIG. 3) in the sub-scanning direction while detecting the presence or absence of the sheet in the multisensor 121. In step S20, the control unit 120 detects the presence or absence of the sheet on the platen 110 using the multisensor 121, to check timing at which the detection is switched from the absence to the presence of the sheet based on the output signal from the multisensor 121.

If the detection is just switched to the presence of the sheet at timing at which the sheet has been conveyed by the distance L, it is understood that the leading edge of the sheet is nipped by the predetermined state illustrated in FIG. 3. Therefore, it is determined that the sheet has not been exchanged while the power is off. This is because that it is unlikely that the user can set the sheet to accurately nip the leading edge of the sheet in the conveyance roller pair when the sheet is exchanged and it is reasonable to determine that the sheet has not been exchanged.

If it is determined that the sheet has not been exchanged ("timing corresponding to distance L" in step S20), then in step S21, the predetermined initializing operations are performed with parts thereof not performed (with parts thereof omitted). The initializing operations that are not performed among the predetermined initializing operations are at least one and preferably all of the following operations (1) to (3) which are required when the sheet is exchanged.

(1) An operation for adjusting the position of the set sheet. When the sheet is set, the sheet may be set to a state inclined diagonally to the original position. Therefore, the inclination of the sheet is corrected. Various methods are known for a skew correction technique for automatically correcting the inclination of the sheet. The specific description thereof is omitted.

(2) An operation for setting the type of the set sheet. There are a method for automatically setting the type of the sheet by detecting the surface reflectance and the surface state of the sheet using the multisensor 121 to determine the type of the sheet, and a method for setting the type of the sheet by the user inputting from the operation unit 107.

(3) An operation for setting the sheet width of the set sheet. There are a method for automatically setting the sheet width by scanning the sheet in the main scanning direction using the multisensor 121, and a method for setting the sheet width by the user inputting from the operation unit 107.

On the other hand, if the control unit 120 detects the presence of the sheet ("timing other than the timing corresponding to the distance L" in step S20), it is understood that the leading edge of the sheet is not in the predetermined state illustrated in FIG. 3. From the above described reason, it is determined that the user has exchanged the roll sheet while the power is off. If the presence of the sheet is detected from the beginning, the leading edge of the sheet is on the platen 110 from the beginning. Therefore, it is determined that the user has exchanged the sheet while the power is off.

If it is determined that the sheet has been exchanged, then in step S22, the control unit 120 performs all the predetermined initializing operations including the above described operations (1) to (3). Then the operation sequence in this flowchart in FIG. 5 is terminated, and the initializing operations relating to printing are performed.

As described above, according to the present exemplary embodiment, the sheet is conveyed and stopped so that the leading edge of the sheet enters the predetermined state before the power is turned off. The control unit 120 thus determines whether the leading edge of the sheet is in the predetermined state if the power is turned on, to perform control not to perform at least parts of the initializing operations if it determines that the leading edge of the sheet is in the predetermined state.

In other words, when the power to the printing apparatus is turned on, the control unit 120 determines whether the sheet has been exchanged while the power is off, based on a change of the sheet state before turn-off and after turn-on of the power. The control unit 120 performs control to perform the predetermined initializing operations if it determines that the sheet has been exchanged, while not performing at least parts of the predetermined initializing operations if it determines that the sheet has not been exchanged.

Such control enables reduction in start time of the printing apparatus by omitting the unnecessary initializing operations. The above described predetermined state is a state in which the leading edge of the sheet is nipped by the conveyance roller pair. Since it is determined whether the user has exchanged the sheet based on this predetermined state, the determination can be performed with high accuracy.

An operation sequence of a printing apparatus according to a second exemplary embodiment will be described. The operation sequence is mainly executed by a control instruction issued by a control unit 120. The configuration of the printing apparatus is the same as the above described configuration according to the first exemplary embodiment.

Figure 6:
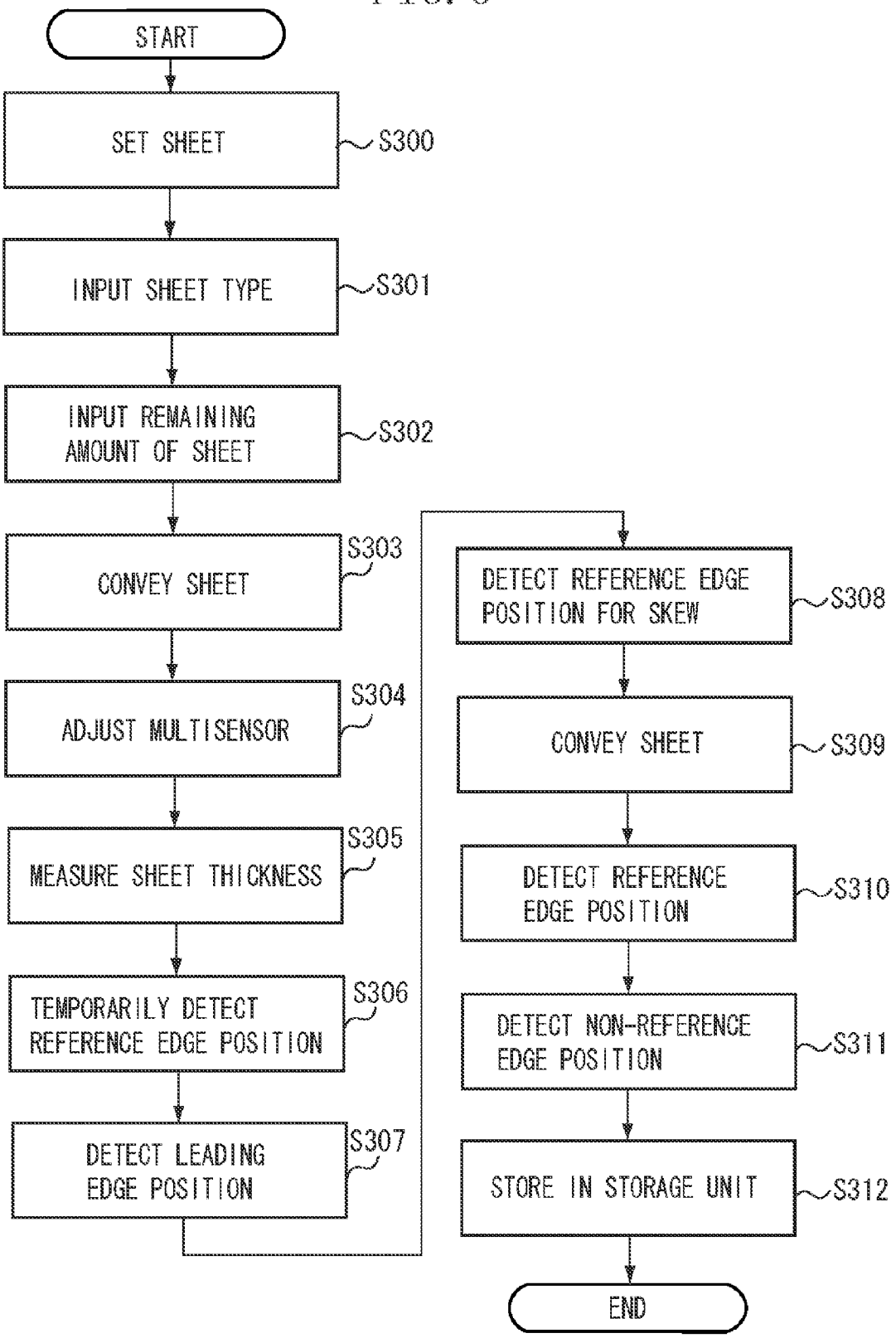
FIG. 6 is a flowchart illustrating an operation sequence in a second exemplary embodiment.

FIG. 6 is a flowchart illustrating a sequence for storing various types of sheet information when a sheet is newly set. In step S300, a user sets the sheet in the holder, and then inserts the leading edge of the sheet into the sheet feeding unit 103. The control unit 120 recognizes from detection by the sensor that the sheet has been set in the holder and the leading edge of the sheet has been inserted into the sheet feeding unit 103.

In step S301, the control unit 120 displays a screen for inputting the sheet type of the set sheet on a display of the operation unit 107 based on the above described recognition to prompt the user to select a sheet type corresponding to the fed sheet. The control unit 120 stores information inputted from the operation unit 107 by the user in a storage unit (a non-volatile memory in the control unit 120) in step S312, described below.

In step S302, the control unit 120 displays a screen for inputting a remaining amount of the set sheet on the display of the operation unit 107 to prompt the user to input information relating to the remaining amount of the sheet (a remaining length of a roll sheet). The information inputted from the operation unit 107 by the user is stored in the storage unit in step S312, described below. If the remaining amount is unclear, the input can be skipped. If the sheet to be used is a cut sheet, step S302 is not required.

In step S303, the control unit 120 conveys the sheet inserted into the sheet feeding unit 103 toward the downstream side (the side on which the roll sheet is pulled out) by a predetermined amount. By this conveyance, the sheet can be reliably fed such that the leading edge of the sheet reaches a detectable position of the multisensor 121 even if a setting position of the sheet by the user (the leading edge position of the sheet) varies.

In step S304, the control unit 120 performs adjustment for detection by the multisensor 121. The carriage 102 carrying the multisensor 121 is moved to perform the detection by the multisensor 121 on each of the sheet and the platen 110. Information such as a proper detection threshold value and color information (hue, saturation) of the sheet can be obtained from an amount of light received by the multisensor 121 on each of the sheet and the platen 110. The color of the light emitting element used for detecting the leading edge of the sheet and a threshold value of the amount of the received light for detecting the edge of the sheet are determined based on the type of the sheet to be used and the detected color information. For example, the green LED and an infrared LED are respectively suited to detect an edge of plain paper and an edge of a transparent film. However, the color of the light emitting element is determined by adding the color information acquired from the amount of received light from each of the LEDs. As the threshold value, an intermediate value between the amounts of light received by the multisensor 121 on the sheet and the platen 110, for example, is set.

In step S305, the control unit 120 measures the actual sheet thickness of the sheet on the platen 110 using the multisensor 121. Information relating to the sheet thickness acquired by the measurement is stored in the storage unit in step S312, described below.

In step S306, the control unit 120 temporarily detects a reference edge position of the sheet. The reference edge position is a position at an edge on a home position side of the carriage 102 (at the right of the sheet illustrated in FIG. 1) in a sheet width direction. A position at an edge on an opposite side to the home position (at the left of the sheet illustrated in FIG. 1) in the sheet width direction is a non-reference edge position. The carriage 102 is moved to scan from the home position toward the opposite side to change the detection position of the multisensor 121. A position where a detection output of the multisensor 121 is changed while the carriage 102 is moving is the reference edge position. Position information of the carriage 102 can be obtained from a control instruction value of a carriage encoder or the carriage 102 at timing at which the detection output has been changed.

In step S307, the control unit 120 detects the leading edge position of the sheet. The control unit 120 moves the carriage 102 such that a measurement position of the multisensor 121 reaches a position which is shifted by a predetermined distance toward the non-reference edge position from the reference edge position detected in step S306. The control unit 120 then searches the position where the detection output of the multisensor 121 is changed, i.e., the leading edge position of the sheet while conveying the sheet in a reverse direction (feeding the sheet back). Information relating to the leading edge position of the sheet can be obtained from a control instruction value of the LF roller 108 or a rotary encoder attached to the LF roller 108 at the timing at which the detection output of the multisensor 121 has been changed. The information relating to the leading edge position of the sheet acquired by the detection is stored in the storage unit in step S312, described below.

In step S308, the control unit 120 detects the reference edge position again to detect the skew state of the sheet. The detection position is at a predetermined distance (e.g., 150 mm) in the upstream side from the leading edge position of the sheet. The control unit 120 conveys the sheet by 150 mm to detect the reference edge position using the multisensor 121, as described above.

In step S309, the control unit 120 conveys the sheet by a predetermined distance (e.g., 300 mm).

In step S310, the control unit 120 detects the reference edge position again. More specifically, in step S310, the control unit 120 detects the reference edge position at a predetermined distance in the upstream side farther apart than in step S308. The skew state of the sheet can be detected by comparing the respective results of the detection in step S308 and S310. The control unit 120 determines that the sheet is not skewed if the results of the detection match with each other, while determining that the sheet is skewed if they do not match with each other. Information relating to an amount and a direction of skew can be obtained from a difference between the results of the detection and magnitude of the results of the detection. The information relating to the reference edge position acquired in step S310 is stored in the storage unit in step S312, described below.

In step S311, the control unit 120 detects the non-reference edge position of the sheet while moving the carriage 102 toward the non-reference edge position. The position where the detection output of the multisensor 121 is changed while the carriage 102 is moving is the non-reference edge position. The position information of the carriage 102 can be obtained from a control instruction value of the carriage encoder or the carriage 102 at timing at which the detection output has been changed. Information relating to the non-reference edge position acquired in the detection in step S311 is stored in the storage unit in step S312, described below.

Further, the control unit 120 calculates a difference between the reference edge position acquired in step S310 and the non-reference edge position acquired in step S311. The difference is information relating to the sheet width. After the above described detecting operation, the LF roller 108 is rotated in the reverse direction to feed the sheet back until the leading edge of the sheet reaches the nipping position of the LF roller 108.

In step S312, the control unit 120 stores various types of sheet information acquired in the above described way in the storage unit. The storage unit is the non-volatile memory in the control unit 120, for example. The storage unit stores the sheet information and maintains the stored sheet information when the power is turned off. In this example, the type of the sheet and the remaining amount of the sheet which are inputted from the operation unit 107, and the leading edge position of the sheet, the reference edge position of the sheet, the non-reference edge position of the sheet, the thickness of the sheet, and the color information of the sheet which are detected in the above described way, are stored as the sheet information. Further, information relating to the sheet width and information relating to the skew state of the sheet which are calculated in the above described way are also stored as the sheet information. Adjustment values for detection by the multisensor 121 (the color of the light emitting element to be used, the threshold value, an optimum height position of the sensor for the sheet, etc.) are also stored as the sheet information. Further, an internal flag relating to conveyance for sheet feeding is also stored. Thus, the sequence in the flowchart in FIG. 6 is terminated.

The above described sheet information may be changed while the printing apparatus is operating. Therefore, the newest sheet information are collectively overwritten and stored in the storage unit at the time when the sheet information is changed or when the power is turned off.

A sequence relating to the initializing operations performed after the power to the printing apparatus according to the second exemplary embodiment is turned on will be described with reference to a flowchart illustrated in FIG. 7. Sheet feeding operations will be extracted and described from among various types of the initializing operations. The operation sequence is mainly executed by a control instruction of the control unit 120.

In step S400, the power to the printing apparatus is turned on. In step S401, the control unit 120 reads out the sheet information which is stored in the storage unit before the power is turned off. Only required information may be read out when it is required in each of the subsequent steps.

In step S402, the control unit 120 performs adjustment for detection by the multisensor 121, as in step S304 illustrated in FIG. 6, described above. The control unit 120 compares the acquired current adjustment value with the adjustment value which is stored in the storage unit before the power is turned off. If these adjustment values match each other as a result of comparison ("MATCHED" in step S402), the processing proceeds to step S403. If the result of the comparison is "UNMATCHED" in step S402, the processing proceeds to step S409.

If the result of the comparison is "UNMATCHED", it is highly possible that the sheet state has been changed (the sheet has been exchanged or the position thereof has been shifted) while the power is off. If the processing proceeds to step S409, therefore, normal sheet feeding operations are performed as initialization. There is an error due to an environmental variation and a change with time in the measurement. Thus, the control unit 120 determines that the result of the comparison is "MATCHED" not strictly but by allowing for a margin of the error. The same is true for the determination in steps S403 to S407, described below.

In step S403, the control unit 120 measures the sheet thickness of the sheet using the multisensor 121, as in step S305 illustrated in FIG. 6, described above. The control unit 120 compares the acquired current sheet thickness and the sheet thickness which is stored in the storage unit before the power is turned off. If the result of the comparison is "MATCHED" in step S403, the processing proceeds to step S404. If the result of the comparison is "UNMATCHED" in step S403, the processing proceeds to step S409 upon determination that the sheet state has been changed while the power is off.

In step S404, the control unit 120 detects the reference edge position of the sheet using the multisensor 121, as in step S306 illustrated in FIG. 6, described above. The control unit 120 compares the acquired current reference edge position with the reference edge position which is stored in the storage unit before the power is turned off. If the result of the comparison is "MATCHED" in step S404, the processing proceeds to step S405. If the result of the comparison is "UNMATCHED" in step S404, the processing proceeds to step S409 upon determination that the sheet state has been changed while the power is off.

In step S405, the control unit 120 detects the non-reference edge position of the sheet using the multisensor 121, as in step S311 illustrated in FIG. 6, described above. The control unit 120 compares the acquired current non-reference edge position with the non-reference edge position which is stored in the storage unit before the power is turned off. If the result of the comparison is "MATCHED" in step S405, the processing proceeds to step S406. If the result of the comparison is "UNMATCHED" in step S405, the processing proceeds to step S409 upon determination that the sheet state has been changed while the power is off.

In step S406, the control unit 120 calculates a difference between the reference edge position acquired in step S404 with the non-reference edge position acquired in step S405 to detect the sheet width of the sheet. The control unit 120 compares the detected sheet width with the sheet width which is stored in the storage unit before the power is turned off. If the result of the comparison is "MATCHED" in step S406, the processing proceeds to step S407. If the result of the comparison is "UNMATCHED" in step S406, the processing proceeds to step S409 upon determination that the sheet state has been changed while the power is off.

In step S407, the control unit 120 detects the leading edge position of the sheet, as in step S307 illustrated in FIG. 6, described above. The control unit 120 compares the detected leading edge position with the leading edge position which is stored in the storage unit before the power is turned off. If the result of the comparison is "MATCHED" in step S407, the processing proceeds to step S408. If the result of the comparison is "UNMATCHED" in step S407, the processing proceeds to step S409 upon determination that the sheet state has been changed while the power is off.

In step S408, the control unit 120 returns the leading edge of the sheet to a position at the time when the power is turned on (which is the same position as before the power is turned off), as required. If all the determinations in steps S402 to S407 are "MATCHED", it is considered that the sheet state has not been changed while the power is turned off.

In step S410, the control unit 120 reads out the sheet information acquired before the power is turned off from the storage unit, and restores the sheet information to the same state as immediately before the power is turned off. Examples of the sheet information to be restored include the leading edge position of the sheet, the reference edge position of the sheet, the non-reference edge position of the sheet, the width of the sheet, the thickness of the sheet, the type of the sheet, the skew state of the sheet, the color information of the sheet, and an internal flag. These pieces of the information are values acquired or set as the sheet is fed, as illustrated in FIG. 6.

If the leading edge position of the sheet is not returned to the position at the time when the power is turned on in step S408, the sheet information is restored by adding an amount of change in state to a value acquired immediately before the power is turned off. More specifically, the sheet information is restored by adding a change in the sheet state for detection by the detection unit to the value stored in the storage unit.

If the sheet state has not been changed while the power is turned off, as described above, the sheet feeding operations that are one type of the initializing operations can be omitted. If the initializing operations are performed with parts thereof omitted, the start time of the printing apparatus when the power is turned on can be reduced accordingly.

If the sheet state has not been changed while the power is turned off, not all the sheet feeding operations but parts thereof may be omitted. For example, only operations for detecting the reference edge and the non-reference edge may be performed and other sheet feeding operations may be omitted after step S410. This is because that if the sheet width is large, the reference edge position and the non-reference edge position may greatly vary by expansion and contraction of the sheet while the printing apparatus is being used.

The above described steps S402 to S407 are an example for determining the change of the sheet state while the power is turned off. It is not essential to perform all the steps. At least one determination may be made.

Figure 7:
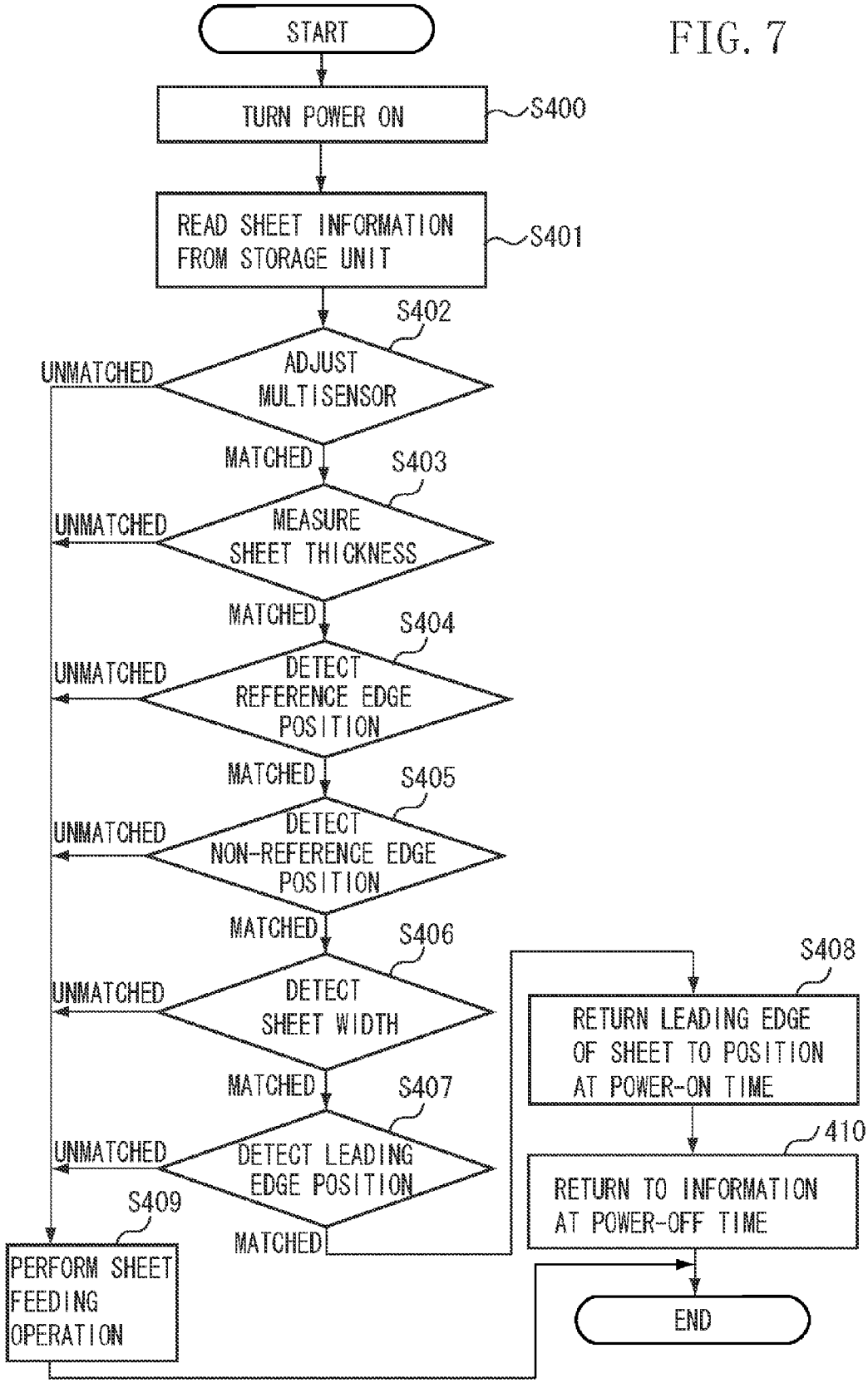
FIG. 7 is a flowchart illustrating an operation sequence of start processing in the second exemplary embodiment.

For example, steps S402 to S406 may be omitted in FIG. 7 to determine the change of the sheet state in only the detection of the leading edge of the sheet in step S407. The simpler an operation for the determination is, the shorter a time period required for initialization may be.

When the leading edge of the sheet is detected, a portion of an image in previous printing may remain at the leading edge position of the sheet. In borderless printing, for example, a sheet is cut at a trailing edge in an image. Therefore, a portion of the image remains at the leading edge of a sheet (e.g., in a range of 3 mm) after the cutting. Alternatively, a cut mark to be a criterion for cutting a sheet may be printed between images. In this case, a portion of the cut mark remains at the leading edge of the sheet (e.g., in a range of 1.5 mm) after the cutting. When a remaining print portion caused by the previous printing of the last image thus remains at the leading edge of a sheet, a criterion for determining whether values match with each other by comparison of the leading edge positions of the sheet may be relaxed. More specifically, a margin for determining that the result of the comparison is "MATCHED" may be expanded by a length corresponding to the remaining print portion.

The roll sheet may be collectively cut for each unit length after a plurality of images is continuously printed thereon. In this case, when the power is turned off during the printing, the leading edge of the sheet cannot be detected when the power is turned on again. More specifically, there exists a predetermined mode in which the leading edge of the sheet cannot be detected by the detection unit when the power is turned on. However, it is unlikely that the sheet remaining in a conveyance path inside the printing apparatus is exchanged while the power is off. Therefore, it may be considered that the sheet state is not changed while the power is off. In a mode in which the power is turned off while continuous printing is being performed and is turned on again, therefore, the sheet information stored in the storage unit may be restored without performing the detection by the detection unit and the sheet feeding operations.

According to the above described present exemplary embodiment, the sheet information is stored in the storage unit before the power is turned off, and at least a part of the sheet information detected by the detection unit and the sheet information stored in the storage unit are compared with each other when the power is turned on. Control is performed to change the initializing operations to be performed according to the result of the comparison. Therefore, an average period of time required for initialization after the power is turned on can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-067906 filed Mar. 19, 2009, which is hereby incorporated by reference herein in its entirety.

What is claimed is:

1. A printing apparatus receiving power to operate, the printing apparatus comprising:

a roller unit configured to convey a sheet for printing;

a printing unit, having a carriage and a print head mounted thereon, configured to print an image on the sheet conveyed by the roller unit;

a sensor mounted on the carriage configured to detect at least one of a type of the sheet based on surface reflectance of the sheet and a width of the sheet; and a control unit configured to perform the following sequence:

(a) upon receipt of a termination request to turn off the power, moving a leading edge of the sheet to be at a predetermined position near the roller unit prior to turning off the power, (b) when the power is turned on, determining if the sheet has been exchanged based on position of the leading edge, and (c) performing predetermined initializing operations regarding an initial process about the sheet according to whether the sheet has been exchanged, wherein the predetermined initializing operations include correcting an inclination of the sheet, setting a type and a width of the sheet based on detection by the sensor.

2. The apparatus according to claim 1, wherein in a case where the leading edge is at the predetermined position, the control unit omits at least one of an operation for adjusting a position of a set sheet, an operation for setting a sheet type of the set sheet, and an operation for setting a width of the set sheet.

3. The apparatus according to claim 1, wherein the predetermined position is a position at which a vicinity of the leading edge of the sheet is nipped by a pair of rollers constituting the roller unit.

4. The apparatus according to claim 3, wherein, prior to turning off the power, the control unit controls the driving of the roller unit using the output of the sensor so that the leading edge is nipped by the pair of rollers.

5. The apparatus according to claim 1, wherein the sensor detects presence or absence of the sheet at the predetermined position.

6. The apparatus according to claim 5, wherein the predetermined position is a position at a predetermined distance in a downstream side from a nipping position of a pair of rollers constituting the roller unit.

7. The apparatus according to claim 6, wherein the control unit moves the sheet toward the downstream side while the sensor detects the presence or absence, and determines that the leading edge is in the predetermined position in a case where the detection of the sheet is switched from the absence to the presence at timing at which the sheet has been conveyed over the predetermined distance.

8. The apparatus according to claim 5, further comprising a second sensor and configured to detect the presence or absence of the sheet on an upstream side from a nipping position of the pair of rollers, wherein the control unit controls the driving of the roller unit using outputs of the sensors.

9. The apparatus according to claim 1, wherein the printing unit performs printing on a roll sheet using an inkjet system.

10. A printing apparatus receiving power to operate, the printing apparatus comprising:

a printing unit, having a carriage and a print head mounted thereon, configured to print an image on a sheet;

a detection unit, having a sensor mounted on the carriage, configured to detect information relating to the sheet, the information including at least one of a type of the sheet based on surface reflectance of the sheet and a width of the sheet;

a storage unit configured to store the information; and a control unit configured to perform the following sequence:

(a) upon receipt of a termination request to turn off the power, storing the detected information detected by the detection unit in the storage unit prior to turning off the power, (b) when the power is turned on, detecting the information by the detection unit, (c) determining if the sheet has been exchanged by comparing the detected information with the stored information, and (d) performing predetermined initializing operations regarding an initial process about the sheet based on whether the sheet has been exchanged, wherein the predetermined initializing operations include correcting an inclination of the sheet, setting a type and a width of the sheet based on detection by the sensor.

11. The apparatus according to claim 10, wherein the predetermined initializing operations include sheet feeding operations, and in a case where the detected information and the stored information are matched with each other, the control unit restores the information and omits at least a part of the sheet feeding operations when performing them.

12. The apparatus according to claim 10, wherein the control unit performs control to cause the detection unit to detect the information when the sheet is set, and to store the detected information in the storage unit.

13. The apparatus according to claim 12, further including a predetermined mode in which the detection unit cannot perform detection when the power is turned on, and does not perform the sheet feeding operation in the predetermined mode.

14. The apparatus according to claim 10, wherein the information is at least one of a type of the sheet, a remaining amount of the sheet, a leading edge position of the sheet, a reference edge position of the sheet, a non-reference reference edge position of the sheet, a width of the sheet, a thickness of the sheet, a skew state of the sheet, and color information of the sheet.

15. The apparatus according to claim 10, wherein the information is a leading edge position of the sheet, and a criterion for determining in the comparison that at least the part of the detected information and the stored information match with each other, is relaxed when a remaining print portion caused by previous printing remains at the leading edge of the sheet.

16. The apparatus according to claim 10, wherein the printing unit performs printing on a roll sheet using an inkjet system.

17. A method for performing initializing operations of an apparatus having a sheet conveying function and receiving power to operate, comprising:

upon receipt of a termination request to turn off the power, memorizing information relating to a position of a sheet to be conveyed prior to turning off the power;

keeping the information in a memory while the power is off;

when the power is turned on, determining whether the position has been changed while the power is off in accordance with the information in the memory; and performing predetermined initializing operations of the apparatus according to a result of the determination, wherein the predetermined initializing operations include correcting an inclination of the sheet, setting a type and a width of the sheet based on detection by the sensor.

18. The method according to claim 17, wherein the state of the sheet is at least one of a type of the sheet, a remaining amount of the sheet, a leading edge position of the sheet, a reference edge position of the sheet, a non-reference reference edge position of the sheet, a width of the sheet, a thickness of the sheet, a skew state of the sheet, and color information of the sheet.

19. The method according to claim 18, further comprising, after the initializing operations, conveying the sheet and performing printing on the sheet using an inkjet system.

* * * * *